US005619961A

United States Patent [19]

Diggs

[11] Patent Number: 5,619,961

[45] Date of Patent: Apr. 15, 1997

[54] POPPET VALVE RETAINER SYSTEM FOR INTERNAL COMBUSTION ENGINE

[75] Inventor: Matthew B. Diggs, Farmington, Mich.

[73] Assignee: Ford Motor Company, Dearborn, Mich.

[21] Appl. No.: 691,126

[22] Filed: Aug. 1, 1996

[51] Int. Cl.[6] ..... F01L 3/10

[52] U.S. Cl. ..... 123/188.13; 123/90.67; 29/214

[58] Field of Search ..... 123/188.6, 188.8, 123/188.13, 90.67; 29/214

[56] References Cited

U.S. PATENT DOCUMENTS

| | | | |
|---|---|---|---|
| Re. 24,928 | 1/1961 | Newton | 123/90.67 |
| 1,390,661 | 9/1921 | Willard . | |
| 2,590,719 | 3/1952 | MacPherson . | |
| 2,855,915 | 10/1958 | Norton | 123/90.67 |
| 3,185,142 | 5/1965 | Peras . | |
| 3,416,771 | 12/1968 | Updike . | |
| 3,656,461 | 4/1972 | Renger et al. | 123/90.67 |
| 3,793,999 | 2/1974 | Seiler et al. . | |
| 5,143,351 | 9/1992 | Pierce | 123/90.67 |

FOREIGN PATENT DOCUMENTS

| | | | |
|---|---|---|---|
| 2033960 | 5/1980 | United Kingdom | 123/90.67 |

*Primary Examiner*—Erick R. Solis
*Attorney, Agent, or Firm*—Jerome R. Drouillard

[57] ABSTRACT

A retainer system for securing a poppet valve within a cylinder head of an internal combustion engine includes a retainer washer having a tapered bore, and a valve stem having annular grooves with different axial lengths which match lands formed on the interior surfaces of tapered keepers. The lands are formed such, that engagement of the keepers with the valve stem is permitted in only a single position.

11 Claims, 2 Drawing Sheets

POPPET VALVE RETAINER SYSTEM FOR INTERNAL COMBUSTION ENGINE

BACKGROUND OF THE INVENTION

1. Field of the Invention

The present invention relates to internal combustion engine poppet valve systems and a means for securing valve spring retainers in such engine systems.

2. Disclosure Information

Internal combustion engines have used popper valves since almost the dawn of the automotive age. Once assembled exclusively by manual labor, it is, of course, desirable to use automation in the assembly of such valve systems. Poppet valve retainers used in automotive cylinder heads are an item which it is particularly desirable to assemble with automation, given the fact that cylinder heads may contain dozens of valves, all of which require meticulous assembly. One problem with automated assembly of poppet valves arises from the fact that if the valve spring keepers have more than one annular land on their interior surfaces, so as to engage more than one groove of the valve stem, it is possible with prior art valve spring retainer and keeper systems for the keepers to be not fully engaged with the valve stem, while still allowing the retainer to assume its fully installed position visa vis the valve stem.

Faced with an improper installation problem, at least one attempt has been made to solve such situation by providing a keeper with unequally sized retention abutments. Thus, as shown in FIG. 7, the retention abutments grow increasingly large as one moves from the direction of the of the valve head to the outboard end of the valve stem. Unfortunately, as illustrated in FIG. 8, the construction shown in FIG. 7 will not solve the problem with improperly engaged valve retainers because the retention abutments at the lower part of the keepers, i.e., the smaller retention abutments, may become engaged with the grooves formed in the upper part of the valve stem, i.e., the larger grooves, and as a result the prior art unequally sized abutment system of FIG. 7 will not solve the problem which is advantageously solved by the present invention.

SUMMARY OF THE INVENTION

A retainer system for securing a poppet valve within a cylinder head of an internal combustion engine includes a retainer washer adapted for assembly upon a valve stem, with the washer having a tapered bore therethrough for accepting a wedge-type keeper assembly. The retainer also includes an abutment surface for contacting an end coil of a valve spring.

The present retainer system further includes a valve stem having a plurality of annular grooves therein, with at least two of the grooves having different axial lengths extending in the longitudinal direction of the valve stem, with the valve stem having a key groove with the greatest axial length being located closest to the head end of the valve.

A keeper assembly according to the present invention comprises a generally conical body having a tapered outer surface sized for a plug-fit into the tapered bore of the retainer washer, and an inner surface having at least two annular lands adapted for mating engagement with the annular grooves of the valve stem. Each of the annular lands has a different axial length, with a key land located at the smallest diameter of the keeper having the greatest axial length.

The axial length of the key land is greater than the axial lengths of any groove in the valve stem above the key groove, and as a result the key land is too large to engage with any of the annular grooves lying above the key groove. The key land has a flattened inner diametrical surface making an acute angle with the outer surface of the keeper.

DETAILED DESCRIPTION OF PREFERRED EMBODIMENTS.

As shown in the various figures, a retainer system according to the present invention is intended for securing conventional spring-loaded popper valves in the cylinder head of an internal combustion engine.

Figure 1:
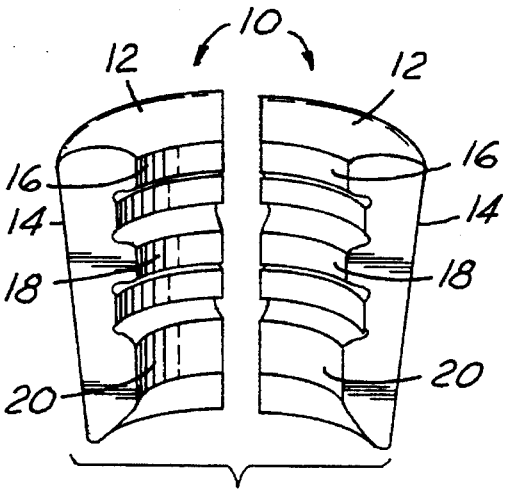
FIG. 1 is a sectional view, partly in elevation, of two keepers according to an aspect of the present invention.
Figure 2:
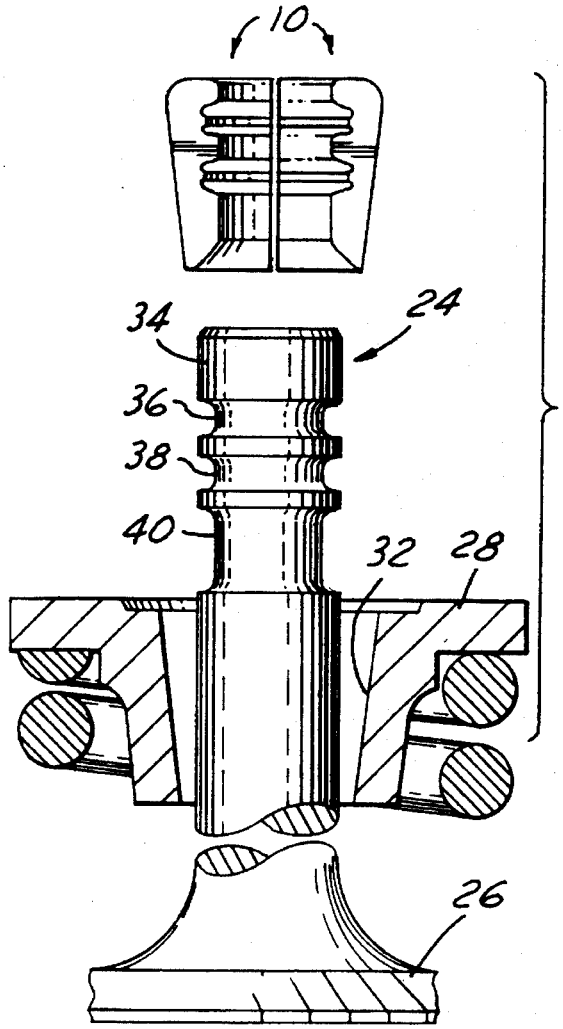
FIG. 2 illustrates a poppet valve spring and retainer and keepers of the present invention positioned for insertion of the keepers into the retainer.
Figure 5:
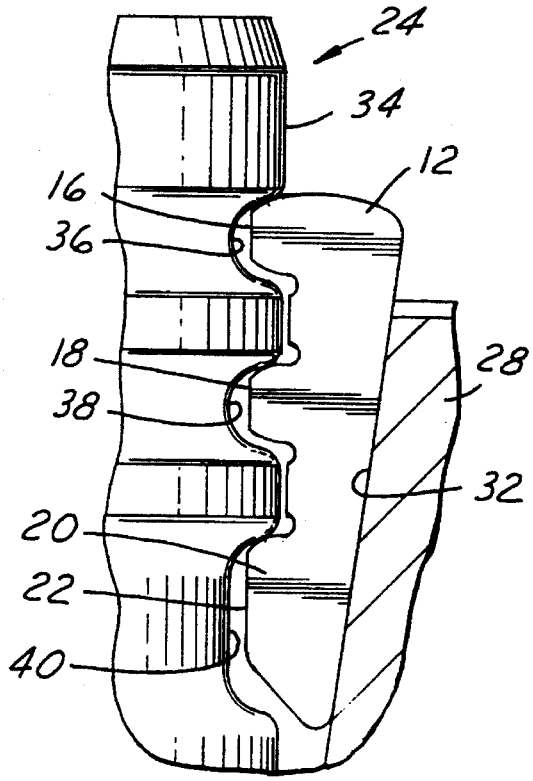
FIG. 5 is an enlarged view of a portion of FIG. 4 which is encircled and labeled 5.

Details of a keeper according to one aspect of the present invention are shown in FIG. 1. Although keeper 10 will preferably be employed as two parts or segments, it is possible that the present keeper could comprise either a single piece of three or more segments mandated by a particular design according to the present invention. In any event, each keeper 10 has a generally conical body 12 having an outer surface 14 which is tapered so as to be a plug-fit with the inner bore 32 of a valve spring retainer washer 28 (FIG. 2). Each of keepers 10 has a plurality of annular lands extending inwardly from the inner surface of the keeper. According to the present invention, the annular lands could comprise at least two, three, four, or more lands depending upon the needs of a particular design. In any event, a keeper according to FIGS. 1–5, has an upper land 16, a middle land 18 which may be the same size as the upper land, and a lowermost, or key, land 20. As seen from the various figures, the axial lengths of some of the lands, particularly the length of key land 20, are different from the lengths of the remaining lands. And, key land 20 has a flattened inner diametral surface 22, which is seen with particularity in FIG. 5.

The purpose of the relatively larger axial length of key land 20 and flattened inner diametral surface 22 is to prevent keepers 10 from engaging improperly with various annular grooves formed in valve stem 34. As shown in FIGS. 2–5, valve stem according to the first embodiment of the present invention, has three grooved regions. These are upper stem groove 36, middle stem groove 38, and key groove 40. As suggested from the various figures, the axial lengths of the upper grooves 36 and 38 are sized to allow mating engagement with upper land 16 and middle land 18 of keepers 10.

Similarly, key groove 40 and key land 20 are sized to allow mating engagement.

Figure 3:
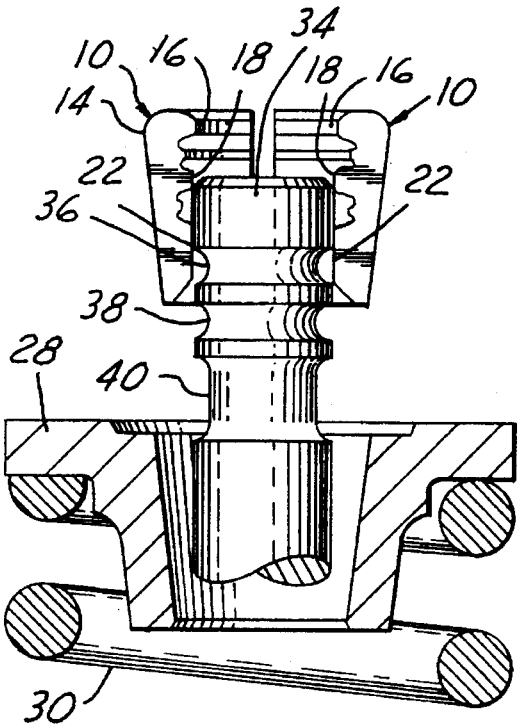
FIG. 3 illustrates the sliding action of the keepers according to the present invention during insertion of the keepers into a spring retainer.
Figure 4:
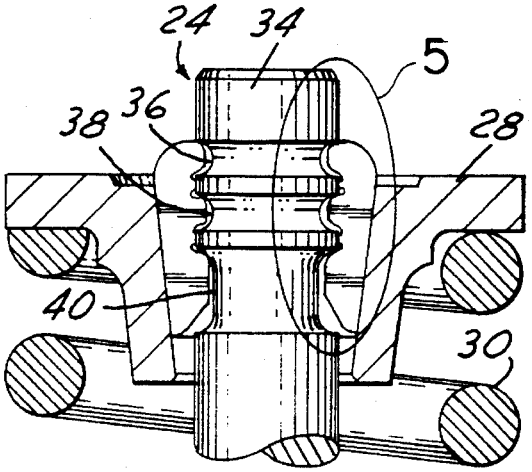
FIG. 4 illustrates a fully installed poppet valve retainer system according to the present invention.

In FIG. 3, two of keepers 10 are shown beginning engagement with valve stem 34. Note that flattened inner diametral surfaces 22 are in sliding contact with the outer diametral surface of valve stem 34 in the region of upper stem groove 36. Flattened area 22 allows keepers 10 to slide past upper and middle grooves 36 and 38 without key land 20 becoming engaged therewith. As a result, in the event that the insertion process fails to cause keepers 10 to engage axially with valve stem 34 such that key lands 20 are engaged with key grooves 40, the entire retainer system, including retainer washer 28, keepers 10, as well as for that matter, spring 30, will move axially upward i.e., in the direction away from valve head 26, which will serve as a clear indication that the retainer system is not securely in place.

Figure 7:
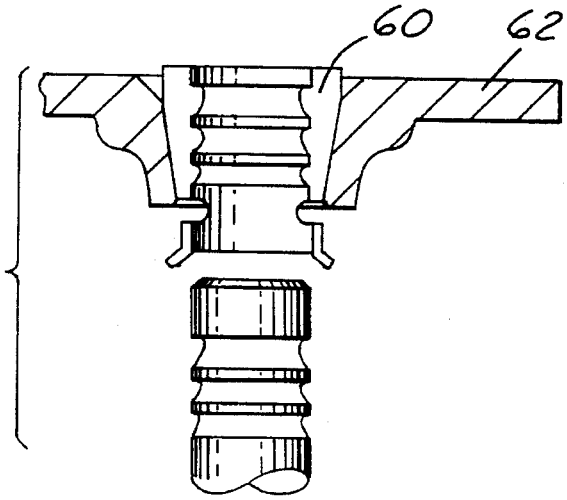
(PRIOR ART) FIG.7
FIGS. 7 and 8 illustrate a prior art valve spring retainer system.
Figure 8:
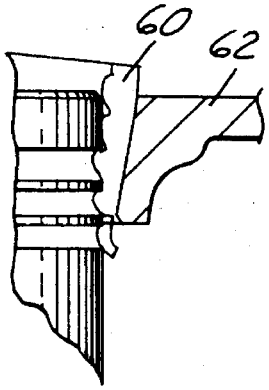
(PRIOR ART) FIG.8

With the prior art system shown in FIGS. 7 and 8, it is possible for the retainer to become lodged in an improper position because the keepers 60 will allow retainer 62 to be positioned too far from the valve's head, inasmuch as the largest land is formed at the top of the retainer keeper, which could allow the lower lands to become engaged with the larger grooves on the valve stem. Also, the retainer of FIGS. 7 and 8 has such great overall length that the length of the valve guides in which the valves are reciprocably mounted will of necessity be shortened to a point where durability of the guides will undoubtedly be adversely affected.

Improper installation of a valve retainer system according to the present invention is prevented because the axial length of key land 20 is greater than the axial lengths of any grooves in valve stem 34 above key groove 40. Thus, according to the present invention, key land 20 of the keeper assembly is always located at the end of keeper 10 which is closer to valve head 26.

According to another aspect of the present invention, a method for installing a retainer system for a popper cylinder valve spring comprises the steps of compressing the spring and a retainer washer, having a tapered bore therethrough for accepting a wedge-type segmented, generally conical body type of keepers with each segment having a tapered outer surface, and slidingly inserting the keeper assembly into the retainer's tapered bore. As before, with each keeper's tapered segments having at least two annular lands projecting from the arcuate inner surface of the keeper and adapted for engagement with grooves formed in the valve stem, improper installation of the keeper is avoided because the annular lands of the keeper have different axial lengths matched with grooves of different axial lengths in the valve stem such that the retainer washer will be allowed to move to its installed position only if the annular lands are mated with the matching grooves in the valve stem.

Figure 6:
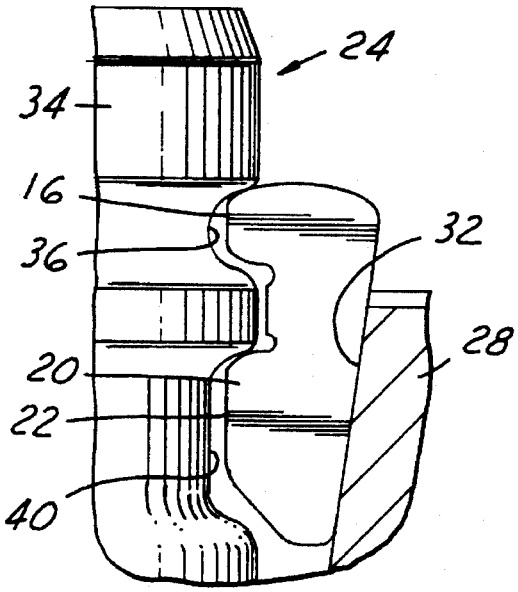
FIG. 6 illustrates a second type of retainer according to the present invention.

FIG. 6 illustrates a second embodiment according to the present invention in which only two annular lands and two mating grooves are used with the current system. Even through there are only two grooves and two lands, improper assembly of the retainer system will be avoided because of the differential axial lengths of the lands and grooves.

While the invention has been shown and described in its preferred embodiments, it will be clear to those skilled in the arts to which it pertains that many changes and modifications may be made thereto without departing from the scope of the invention.

I claim:

1. A retainer system for securing a popper valve within a cylinder head of an internal combustion engine, comprising:

a retainer washer adapted for assembly upon a valve stem, with said washer having a tapered bore therethrough for accepting a wedge type keeper assembly, and an abutment surface for contacting an end coil of a valve spring;

a valve stem having a plurality of annular grooves therein, with at least two of said grooves having different axial lengths extending along the longitudinal direction of the valve stem, with a key groove having the greatest axial length being located closest to the head end of the valve; and a keeper assembly comprising a generally conical body having a tapered outer surface sized for a plug fit into the tapered bore of the retainer washer and an inner surface having at least two annular lands adapted for mating engagement with said annular grooves, with the lands having different axial lengths, and with a key land located at the smallest diameter of the keeper having the greatest axial length.

2. A retainer system according to claim 1, wherein the key land has an axial length which is greater than the axial lengths of any groove in the valve stem above the key groove, such that the key land is too large to engage with any of the annular grooves lying above the key groove.

3. A retainer system according to claim 1, wherein said valve stem has two annular grooves positioned between a free end of the valve and the key groove.

4. A retainer system according to claim 1, wherein the key land of said keeper assembly is located at the end of the keeper which is closer to the valve head.

5. A retainer system according to claim 1, wherein the key land has a flattened inner diametral surface having a length which exceeds the axial length of all of said grooves other than said key groove.

6. A retainer system according to claim 1, wherein the key land has a flattened inner diametral surface making an acute angle with the outer surface of the keeper.

7. A retainer system for securing a popper valve within a cylinder head of an internal combustion engine, comprising:

a retainer washer adapted for assembly upon a valve stem, with said washer having a tapered bore therethrough for accepting a conical, multi-piece wedge keeper assembly, and an abutment surface for contacting an end coil of a valve spring;

a valve stem having a plurality of annular grooves therein, with at least two of said grooves having different axial lengths extending along the longitudinal direction of the valve stem, with a key groove having the greatest axial length being located closest to the head end of the valve; and a keeper assembly comprising a segmented, generally conical body, with each segment having a tapered outer surface sized for a plug fit into the tapered bore of the retainer washer and an inner surface having at least two annular lands adapted for mating engagement with said annular grooves, with the lands having different axial lengths, and with a key land located at the smallest diameter of the keeper having a flattened inner diametral surface with an axial length which is greater than the axial lengths of any groove in the valve stem above the key groove, such that the key land cannot engage with any of the annular grooves lying above the key groove.

8. A retainer system according to claim 7, wherein said valve stem has two annular grooves positioned between a free end of the valve and the key groove.

9. A retainer system according to claim 7, wherein the key land of said keeper assembly is located at the end of the keeper which is closer to the valve head.

10. A retainer system according to claim 7, wherein the flattened inner diametral surface of the key land makes an acute angle with the outer surface of the keeper.

11. A method for installing a retainer system for a poppet cylinder valve spring, comprising the steps of:

compressing the spring and a retainer washer having a tapered bore therethrough for accepting a wedge type keeper assembly;

slidingly inserting a conical, multi-piece, wedge keeper assembly into the retainer's tapered bore, with said keeper assembly comprising a plurality of individual keeper segments, with each segment having at least two annular lands projecting from an arcuate inner surface and adapted for engagement with grooves formed in a seem of a popper valve secured by the retainer system, and with said annular lands having different axial lengths matched with grooves of different axial length in the valve stem such that the retainer washer will be allowed to move to its installed position upon the valve stem only if the annular lands are mated with the matching grooves in the valve stem.

* * * * *